United States Patent [19]

Kreinberg

[11] Patent Number: 4,867,700

[45] Date of Patent: Sep. 19, 1989

[54] WAVE CRIMP FOR FLAT POWER CABLE TERMINATION

[75] Inventor: Earl R. Kreinberg, Phoenix, Ariz.

[73] Assignee: AMP Incorporated, Harrisburg, Pa.

[21] Appl. No.: 298,259

[22] Filed: Jan. 13, 1989

Related U.S. Application Data

[63] Continuation of Ser. No. 193,458, May 13, 1988, abandoned, which is a continuation-in-part of Ser. No. 50,793, May 14, 1987, abandoned.

[51] Int. Cl.[4] ..... H01R 4/24

[52] U.S. Cl. ..... 439/422

[58] Field of Search ..... 439/409, 410, 421, 422

[56] References Cited

U.S. PATENT DOCUMENTS

| | | | |
|---|---|---|---|
| 2,759,161 | 8/1956 | Berg . | |
| 3,201,744 | 8/1965 | Dean . | |
| 3,247,316 | 4/1966 | Weimer, Jr. . | |
| 3,259,873 | 7/1966 | Parkinson et al. . | |
| 3,668,613 | 6/1972 | Klosin . | |
| 3,825,881 | 7/1974 | Wigby . | |
| 3,881,796 | 5/1975 | Saunders . | |
| 4,082,402 | 4/1978 | Kinkaid et al. . | |
| 4,106,836 | 8/1978 | Asick et al. | 439/422 |
| 4,241,498 | 12/1980 | Brandeau . | |
| 4,248,493 | 2/1961 | Kuo | 439/422 |
| 4,326,764 | 4/1982 | Asick et al. . | |

OTHER PUBLICATIONS

AMP Data Sheet 74–279 Issued 7–84, "AMP TERMI-FOIL Terminals and Splices", AMP Incorporated, Harrisburg, Pa. Ser. No. 07/127,992.

*Primary Examiner*—Joseph H. McGlynn
*Attorney, Agent, or Firm*—Anton P. Ness

[57] ABSTRACT

A transition adapter for terminating flat power cable includes at least a stamped and formed member having opposed plate sections between which an end or an edge portion of the cable is receivable to be terminated. The plate sections have opposing cooperating terminating regions comprised of a plurality of alternating wave shapes and relief recesses, with each wave shape aligned with a recess of the opposing terminating region. When the plate sections are urged together under sufficient force, shearing edges along each side of each wave shape shear the cable conductor by cooperating with shearing edges of the adjacent wave shape of the opposing terminating region, scissors-fashion. Crests of the wave shapes deflect the sheared cable portions into the opposing relief recesses, forming a series of interlocking wave joints across the intermeshing terminating regions and terminating the cable between the plate sections. The wave crests deflect integral strips of conductor out of the plane of the cable, exposing sheared conductor edges for electrical connection therewith such as with solder. Softer metal insert members may be secured to and along outer surfaces of the plate sections to engage and form gas-tight electrical connections with substantial surface areas of the sheared conductor edges.

41 Claims, 11 Drawing Sheets

300
302
304
306
308
310
312
314
316
318
320
322
324
326
328
330
332
334
336
338

WAVE CRIMP FOR FLAT POWER CABLE TERMINATION

This application is a continuation of application Ser. No. 193,458 filed May 13, 1988, now abandoned which was a continuation-in-part of application Ser. No. 050,793, filed May 14, 1987 now abandoned.

FIELD OF THE INVENTION

The invention relates to electrical terminals and more particularly to the termination of terminals to flat power cable.

BACKGROUND OF THE INVENTION

U.S. patent application Ser. No. 07/050,793 discloses a transition adapter which is secured onto a flat power cable by being crimped thereto, and the adapter includes one or more contact sections to be engaged with corresponding contacts of an electrical connector to transmit power from the cable to the connector. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. The metal of the flat conductor is for example of Copper Alloy 110 and the insulation is for example TEFZEL thermoplastic resin known as polyethylene-co-tetrafluoro-ethylene copolymer (trademark of the E. I. DuPont de Nemours and Company, Wilmington, Del.).

The transition adapter of Ser. No. 07/050,793 includes a pair of plate sections hinged together at the forward or terminal end of the adapter, and a still-insulated end or edge portion of the cable is to be crimped therebetween. At a selected location forwardly of the cable-crimping region at least one of the plate sections is bent at an angle away from the other so that the plate sections are facing each other at an angle and are thus spaced apart to receive the cable end or edge therebetween. A plurality of lances extend from one plate section toward corresponding apertures in the other so that upon pressing the plate sections together the lances penetrate through the cable. The lances are then received through the apertures and the ends thereof are bent over and against the outer surface of the other plate section, being bent over by tool means or by being curled around by integral arcuate guides at each aperture. By penetrating the cable a plurality of electrical connections are formed between the adapter and sheared conductor edges of the cable. By being stamped from sheet metal of an appropriate alloy, the lances are preferably defined by shear edges and penetrate through the insulation and also the conductor of the cable in cooperation with the lance-receiving apertures which preferably include at least one shear edge against which the cable is pressed during penetration by the lances. Additional electrical connections are made by a plurality of barbs which penetrate the cable insulation to engage and bite into the cable conductor.

It is desirable to provide an adapter having means for shearing through a flat power cable conductor at a plurality of locations to provide a plurality of electrical connections between the adapter and the cable conductor wherein the connections are and remain gas-tight by reason of stored energy.

It is also desirable to provide each gas-tight connection with substantial surface area of engagement between the adapter and the cable's conductor.

It is further desirable to provide elongated gas-tight connections to provide greater interconnecting metal surface area.

It is yet further desirable to provide mechanical and electrical connective joints between an adapter and a flat cable which remain strong and viable and do not weaken over long-term in-service use.

It is still further desirable to provide an adapter of a metal alloy compatible with transmission of electrical power and which retains its stamped and formed shape and its shear edges to penetrate the cable, and also to provide an adapter of a metal alloy capable of assuming a shape upon termination to the cable which maximizes surface area engagement with the sheared edges of the cable conductor while retaining stored energy to maintain the gas-tight nature of the connections during long-term in-service use.

SUMMARY OF THE INVENTION

The present invention is an adapter crimpable to a flat power cable by penetrating the insulation covering the cable's conductor and also shearing through the conductor at a plurality of locations. The adapter is stamped and formed of sheet metal and in one embodiment includes at least one plate section to be disposed along a major surface of the cable upon termination and including at least one terminating region transversely thereacross, which is formed of one or preferably several spaced wave shapes. When the plate section is urged against the insulated flat cable which is supported by an appropriate die, the wave crests begin to deflect the engaged cable portions into relief recesses of the die surface; simultaneously the shearing edges at ends of the wave crests penetrate and tear the insulation covering and begin shearing the portions of the cable adjoining the crest-deflected cable portions which in turn allows substantial further deflection by the wave crest and also elongation of the crest-deflected conductor portions. The sheared conductor edges of the crest-deflected cable portions are thus pushed out of the plane of the cable and are exposed along substantial lengths such as 0.25 inches to be electrically joined such as by being soldered to the adapter, or by a soft copper adapter portion being staked and thereby deformed tightly against the exposed conductor edges. The plate section maintains a mechanical attachment to the cable by reason of the end portions shearing edges of the wave shapes tightly engaging the sheared edges of the cable conductor at the ends of the crest-deflected conductor portions; additional retention means may be used such as conventional lances penetrating the cable and bent over along the far side, or tabs bent over about the side edges of the cable.

In a second embodiment, the adapter includes a body member having a pair of opposed plate sections each having at least one terminating region transversely thereacross, with the terminating regions of the opposed plate sections being associated in opposing pairs. Each terminating region of the pair is formed of alternating wave shapes and relief recesses, and the plurality of wave shapes of one plate section extend toward the other plate section and are spaced from each other by the relief recesses, with the wave shapes of one plate section corresponding with the relief recesses of the other. Each wave shape includes a transverse radiussed crest extending between parallel axially aligned shearing edges which are perpendicular with respect to the crest. Essentially the wave shapes of one plate section would intermesh with those of the other if urged toward each other, but preferably essentially with zero clearance.

The transition adapter is terminated to a cable disposed between the plate sections, by the preferably hingedly joined plate sections being pressed tightly together with the cable therebetween. Each wave shape will be forced against an adjacent surface portion of the cable and its crest will deflect that adjacent surface portion of the cable out of the plane of the cable and will stretch the conductor portion thus deflected. Simultaneously, the shearing edges of that wave shape cooperate with the shearing edges of the adjacent wave shapes of the opposed plate section: the shearing edges are aligned under zero clearance and pair up so that when the wave shapes are forced against the opposite surface of the cable, the paired shearing edges penetrate and tear the insulating layers and shear the conductor perpendicularly to the wave crest. Preferably an arcuate relief shape is formed at each relief recess extending away from the other plate section, and each wave shape is received into a corresponding opposed relief recess with the crest-deflected cable portion disposed between the wave's crest and the inner surface of the opposed arcuate relief shape. Portions of each shearing edge of the wave shapes of one plate section of the adapter engage newly formed edges of the cable conductor sheared by the adjacent wave shapes of the other plate section. The cable conductor is sheared at a plurality of locations for axial shear lengths of for example 0.25 inches and substantially without great bulk deformation of the metal thereof during the shearing process. Also since the shearing is axial with respect to the cable when the adapter is terminated on an end of the cable, the cable is not materially weakened. Essentially the intermeshing adapter wave shapes form a plurality of interlocking wave joints with the cable conductor thus defining a strong termination transversely across the cable, with the opposing plate sections acting as a zero clearance tool and die which will resist opening thereafter.

According to an aspect of the present invention, a pair of insert members are preferably affixed to and predisposed against the outwardly facing surfaces of the respective plate sections of the stamped and formed adapter body member of the second embodiment, along and across the terminating or wave regions thereof. Each insert member is shaped to conform to the wave region of the associated plate section by having conforming wave shapes and by having apertures within which the arcuate relief shapes are disposed. Each insert member is formed of high copper content alloy and is malleable so that after shearing the cable, each wave shape of the insert member may for example be deformed by a staking operation. Each wave shape of the insert member would be staked from the outwardly facing surface of the insert member to expand the wave shape tightly and fully against the sheared edges of the cable conductor now beside that wave shape on both sides, and also against the adjacent shearing edges of the adjacent wave shapes of the adapter body member. The insert members are adapted to establish the primary electrical connections to the cable conductor, while the transition adapter body member provides the strong mechanical means of attachment to the cable.

It is an objective of the present invention to provide an adapter for terminating to flat power cable which is easily applied without cable preparation, which results in an assured electrical and mechanical connection to the cable.

It is another objective to provide gas-tight joints between the adapter and the cable conductor which retain substantial stored energy thereat for long-term in-service use and do not relax due to heat and vibration over time.

It is also an objective of the present invention to provide an adapter which selectively deforms the cable in cooperation with the shearing of a plurality of locations for substantial lengths without materially weakening the cable conductor, to expose the sheared conductor edges for the forming of a plurality of electrical connections having substantial surface area.

It is yet another objective to provide an adapter which includes a metal portion stiff enough to be capable of including edges for shearing through a relatively thick (0.020 inches) metal conductor at a plurality of locations for substantial lengths, while including a metal portion capable of being formed to conform tightly against substantially the entire surface area of the sheared conductor edges with stored energy after cable penetration.

It is still another objective to provide an adapter which after cable termination distributes current carried by the conductor evenly to selected contact sections in an assured manner.

Embodiments of the present invention will now be described with reference to the accompanying drawings.

DETAILED DESCRIPTION OF THE PREFERRED EMBODIMENT

Figure 1:
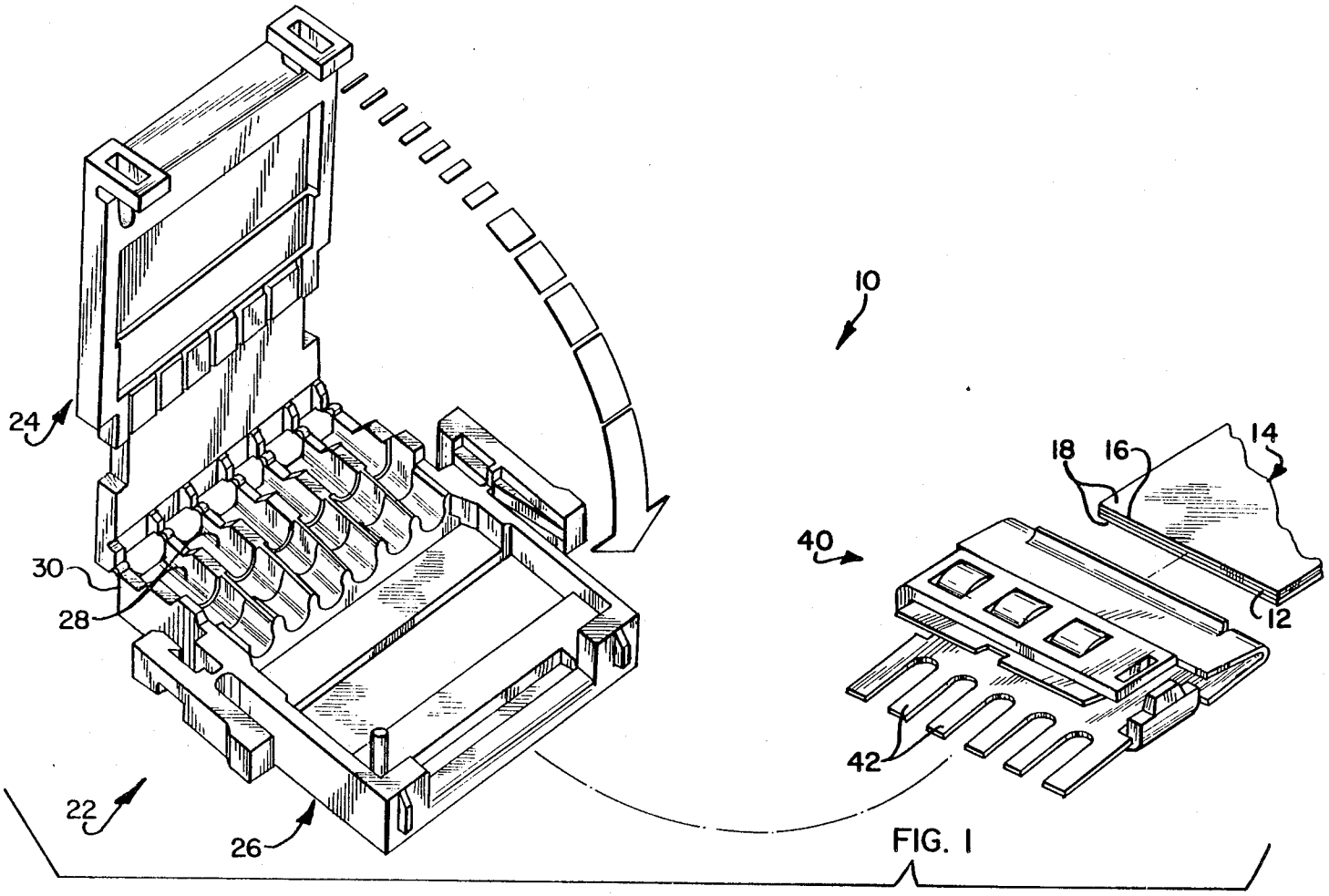
FIG. 1 illustrates an electrical connector for flat power cable utilizing the transition adapter of the present invention.

FIG. 1 illustrates the connector assembly 10 in which the transition adapter 40 of the present invention is used to terminate an end 12 of flat power cable 14 for a power distribution system for within electronic devices such as computers, copying machines and the like, and also for card cage systems such as that disclosed in U.S. patent application Ser. No. 07/127,992 filed Dec. 2, 1987 and assigned to the assignee hereof. Cable 14 is of the type comprising a flat conductor 16 such as 0.020 inches thick copper or aluminum with an insulative coating 18 extruded therearound, such as four to eight mils thickness of TEFZEL thermoplastic resin (trademark of E. I. DuPont de Nemours and Company) along each surface. After application of transition adapter 40 onto cable end 12, the terminated end is secured within a dielectric housing assembly 22 comprising first and second cover members 24,26 for example. Cover members 24,26 can be hinged to facilitate being rotated together and latched to enclose the terminated cable end. Passageways 28 extend inward from mating face 30 to contain the contact sections of the adapter for mating to corresponding contacts (not shown). The housing assembly can be configured in accordance with the type of contact section or sections 42 desired to be formed on the adapter 40, and also the particular use to which the connector is to be put. A variety of contact sections for the transition adapter is disclosed in U.S. patent application Ser. No. 07/050,793 filed May 14, 1987 and assigned to the assignee hereof.

Figure 3:
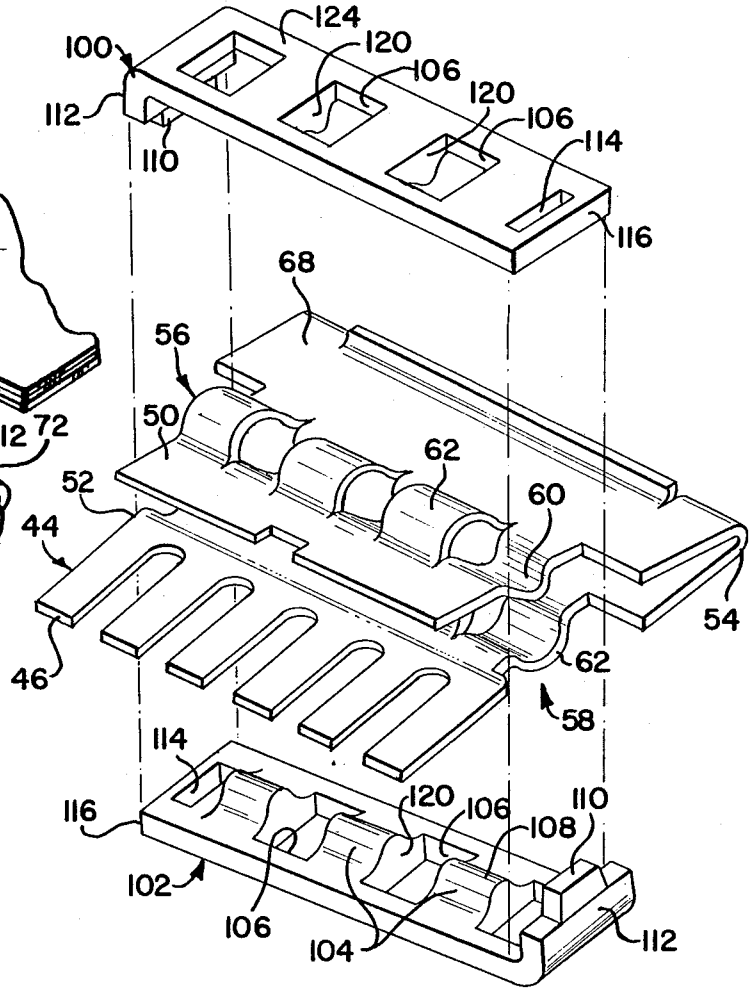
FIG. 3 is an isometric view of the adapter with the inserts exploded from the body member.
Figure 2:
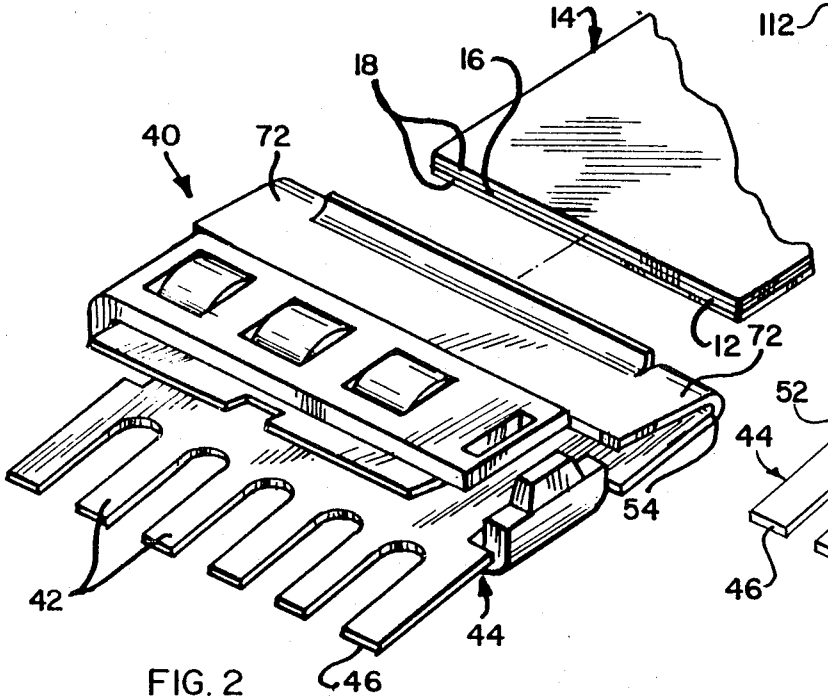
FIG. 2 is an isometric view of the transition adapter of FIG. 1 ready to receive a cable end thereinto for termination.
Figure 11:
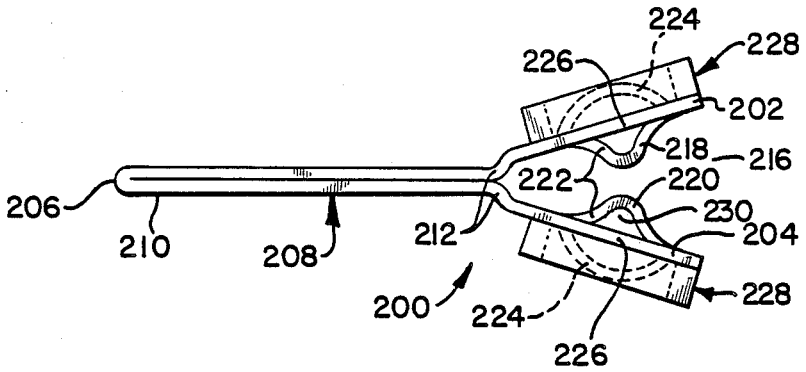
FIGS. 11 and 12 are elevation and isometric views of an alternate embodiment of transition adapter with inserts.
Figure 12:
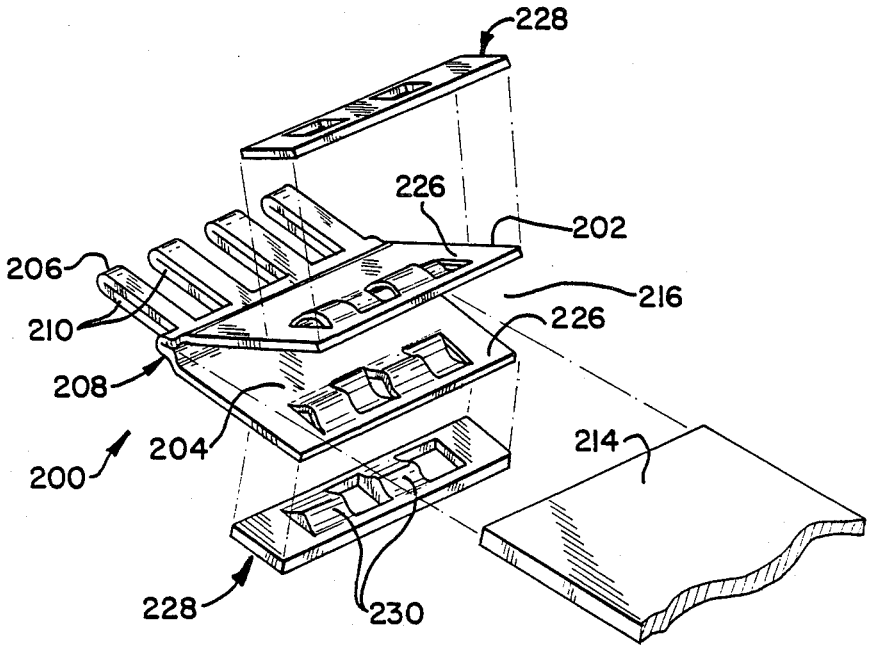

In FIGS. 2 and 3, transition adapter 40 of the present invention includes at least a body member 44 to which the one or more contact sections 42 are joined or are an integral part, at mating end 46. Body member 44 also includes a cable-receiving end 48 which may be at the opposite end from mating end 46. Body member 44 also includes a pair of plate sections 50,52 preferably integrally joined at hinge 54 so that the plate sections after termination will be disposed in parallel along opposed major side surfaces of cable end 12 and clamped onto cable 14. Preferably and as shown, hinge 54 is located at cable-receiving end 48 although the hinge can also be located proximate mating end 46 as seen in FIGS. 11 and 12.

Plate sections 50,52 have respective opposed terminating regions 56,58 extending transversely thereacross, each comprising a row of spaced wave shapes 60 (see FIG. 6A) alternating with relief recesses formed by arcuate relief shapes 62. Each of the wave shapes of each of the plate sections is located opposed from an arcuate relief shape of the other of the plate sections. The wave shapes of each plate section extend outwardly of the cable-proximate surface 64 thereof and toward the other plate section to radiussed crests 66 (FIG. 6A); the arcuate relief shapes extend outwardly of the cable-remote surface 68 thereof and away from the other plate section. Essentially wave shapes 60 of each of plate sections 50,52 present a cooperating pattern with wave shapes 60 of the other which are offset, and the wave shapes would intermesh if the plate sections were to be urged against each other about hinge 54.

Preferably transition adapter 40 includes insert members 100,102 to establish assured electrical connections to cable conductor 16. One method of using insert members is disclosed in U.S. patent application Ser. No. 07/193,852 filed May 13, 1988 and assigned to the assignee hereof. Insert members 100, 102 are affixed to cable-remote surfaces 68 of respective plate sections 50,52 of body member 44 across termination regions 56,58 thereof. Each insert member 100,102 has a pattern of wave shapes 104 alternating with relief apertures 106 likewise presenting a cooperating pattern with those of the other insert member after being secured appropriately to body member 44. Wave shapes 104 include crests 108 and are shaped to conform to the adjacent surfaces of corresponding wave shapes 60 of the plate section to which the insert member is affixed. Preferably each of insert members 100,102 includes a shaped boss 110 at one end 112 and a shaped boss-receiving aperture 114 at the other end 116 so that upon termination the shaped boss of one insert member is received into the boss-receiving aperture of the other.

Figure 6A:
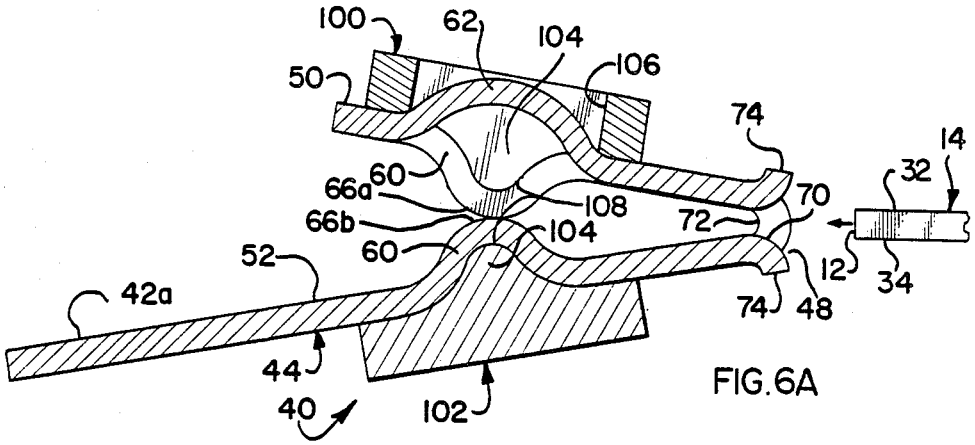
FIGS. 6A to 6C are longitudinal section views of the adapter ready to receive a cable end thereinto, after receiving the cable end, and after being terminated thereonto respectively.

In FIGS. 2 and 6A cable end 12 is insertable into cable-receiving end 48 of transition adapter 40 which preferably comprises a slot 70 (FIG. 4) extending between a pair of hinge sections 72 of body member 44 joining plate sections 50,52 as is, described in U.S. patent application Ser. No. 07/194,063 filed May 13, 1988 and assigned to the assignee hereof. It is preferable that plate sections 50,52 be previously bent almost together about hinge sections 72 prior to cable insertion, with crests 66 of wave shapes 60 close enough together so that the spacing therebetween has a dimension smaller than the thickness of cable 14, so that cable end 12 deflects plate sections 50,52 slightly outwardly against spring bias generated at hinge sections 72 so that transition adapter 44 self-retains onto cable end 12 to facilitate handling prior to the crimping step to follow. Hinge sections 72 should be formed to have a radius about equal to one half of the cable thickness. Outwardly extending flanges 74 along both sides of elongated slot 70 provide strength after termination to provide resistance to plate sections 50,52 being deflected apart resulting from torque which may be applied to the transition adapter due to stresses on the relatively wide, relatively stiff cable.

Figure 4:
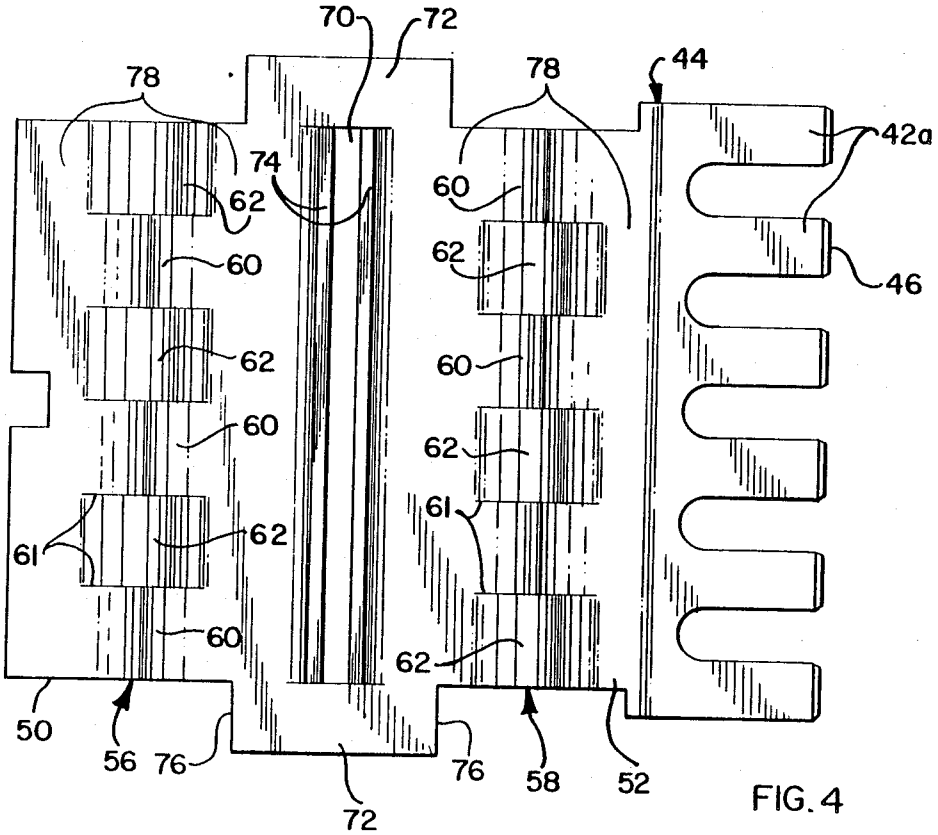
FIG. 4 is a plan view of the body member prior to its plate sections being bent back along each other.

FIG. 4 shows the metal blank of body member 44 prior to application of insert members 100,102 thereto, and prior to being bent at hinge sections 72. Blade type contact sections **42*a* are shown at mating end 46; plate sections 50,52 are shown on either side of slot 70 and flanges 74; and terminating regions 56,58 are seen to have a width across body member 44 about equal to that of a cable, with recesses 76 on either side of hinge sections 72 providing clearance for the bosses 110 of each of insert members 100,102 (FIG. 3) to extend beside body member 44 upon termination to be received in boss-receiving apertures 114 of the opposed insert member. Terminating regions 56,58 are slit at equally spaced, precisely opposed locations during the formation of the wave shapes 60 and arcuate relief shapes 62 in a manner not creating gaps laterally between the formerly joined shearing edges at slits 61. Plate sections 50,52 also include integral portions 78 forwardly and rearwardly of the ends of slits 61. Flanges 74 can be comprised of the metal formed from creating slot 70** and are bent 90° about small radii.

Body member 44 can be formed for example from strip stock of 0.025 inches thick copper alloy such as sold by Olin Corporation under Alloy No. 7025 half hard copper alloy, or such as Alloy No. 151 tempered hard alloy, Temper No. H05 with annealing for good stress relaxation properties. Insert members 100,102 can be formed for example of dead soft Copper CDA 110 generally about 0.066 inches thick with a height at the wave crest 108 of about 0.132 inches, and can have a length in the axial direction of about 0.326 inches. Both the insert members and the body member can be silver plated, if desired, to assure the integrity of the electrical connection for long-term in-service use.

Figure 5:
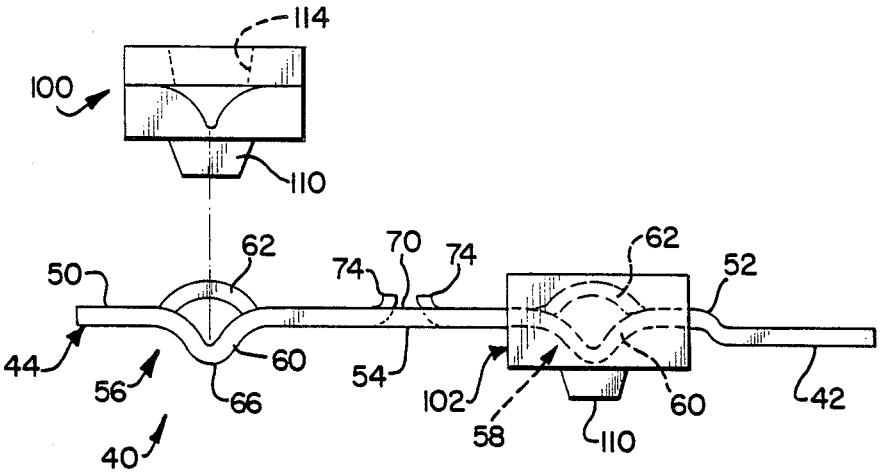
FIGS. 5 and 5A are elevation views showing the insert members being affixed to the body member, and an enlarged isometric part-sectional view thereof illustrating staking.
Figure 5A:
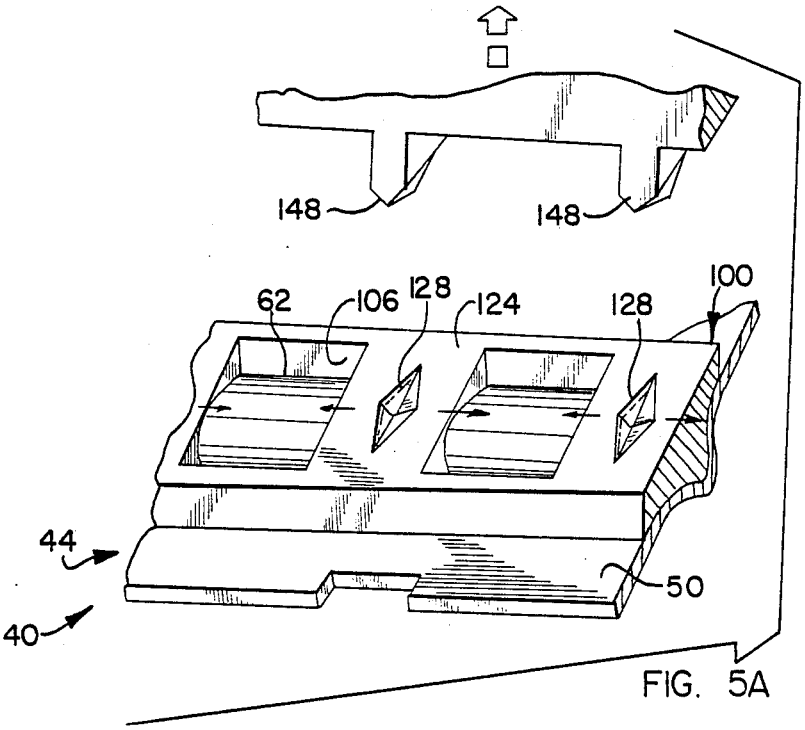

Referring to FIGS. 5 and 5A, each insert member 100,102 can be affixed to a respective plate section 50,52 by a slight staking operation wherein the insert members are tapped by blades 148 centered on the outwardly facing surface of each raised wave shape, which slightly deforms the insert wave shape laterally against the edges of the adjacent arcuate relief shapes of the particular adapter plate section to which the insert member is being secured.

Figure 6B:
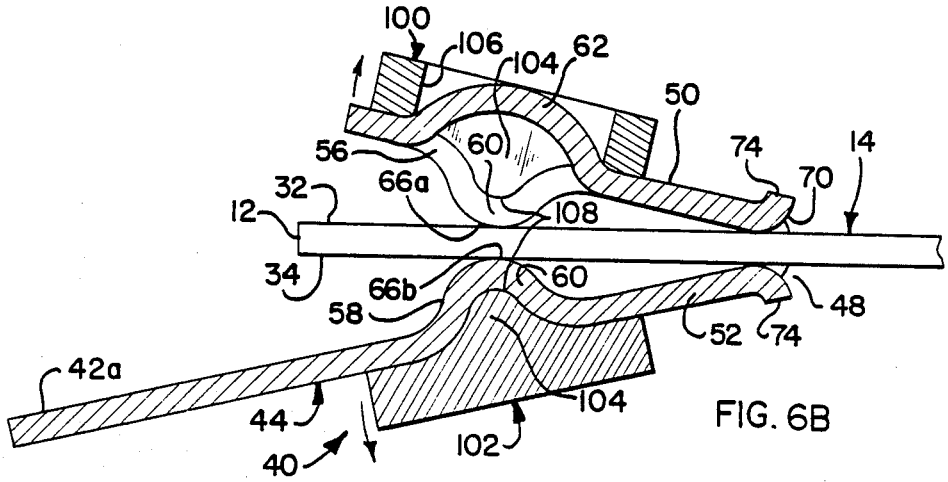
Figure 6C:
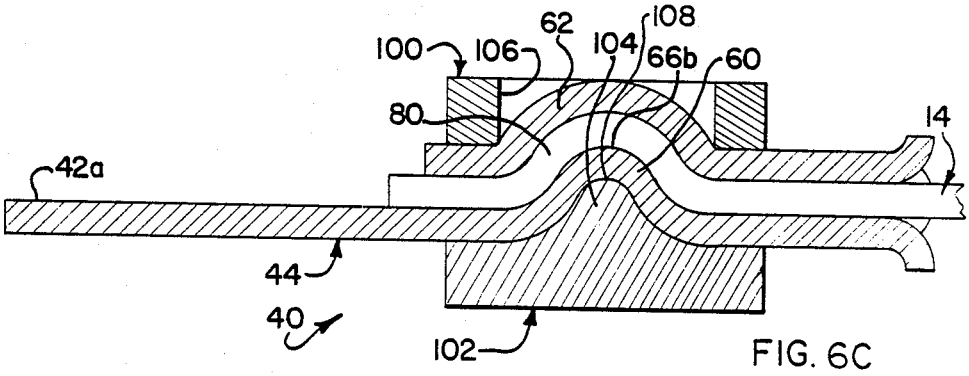

In FIG. 6A the assembled transition adapter 40 is ready to receive cable end 12 into cable-receiving end 48, and wave shapes 60 are almost together at upper and lower crests *66a,66b*. The cable end is inserted into slot 70 and deflects plate sections 50,52 apart in FIG. 6B and is moved forwardly until leading edge 12 is appropriately located a small distance in front of the terminating regions 56,58 but rearwardly of contact sections *42a*. Spring bias at hinge sections 72 creates a gripping of the cable by the crests *66a,66b* against insulated upper and lower surfaces 32,34 of cable 14. In FIG. 6C the transition adapter 40 has been pressed together by tooling 150 (FIG. 7A) such as an arbor press. Shearing edges created by slits 61 along the sides of wave shapes 60 of each plate section have acted in cooperation with those of the offset wave shapes of the opposing plate section and have first punctured and torn the tough, ductile insulative coating 18 of cable 14 and have sheared the cable conductor 16 lengthwise for distances of about 0.25 inches. Crests *66a,66b* have deflected outwardly and elongated the thus sheared portions of cable conductor 16 forming alternatingly upward and downward arcuate conductor loops within the opposed arcuate relief shapes of the opposing plate section. At each wave shape 60 has been formed a wave joint 80. In the present embodiment there are shown six wave joints 80 transversely entirely across cable 14, and the transition adapter of the present invention can easily be modified to create four such wave joints leaving integral adapter straps along lateral ends of the termination regions.

It is believed that the wave shapes assist the shearing of the cable by initiating the outward deflection of the cable in opposite directions first at a single point along the cable axis (by the wave crest) and then gradually axially forwardly and rearwardly therefrom and also by initiating the shearing first at that single point simultaneously with the deflection from both surfaces of the cable by paired shearing edges having zero clearance. The deflected conductor strips remain integrally joined to the cable and the cable is not materially weakened. The termination is considered to be controlled and precise and is performed by shearing edges of the adapter itself and without any prior preparation of the cable required. Another benefit of the present invention is that since the transition adapter grips the cable after cable insertion, handling to place the cable end into the application tooling is simplified since the stiff cable itself is used for manipulation.

Figure 7A:
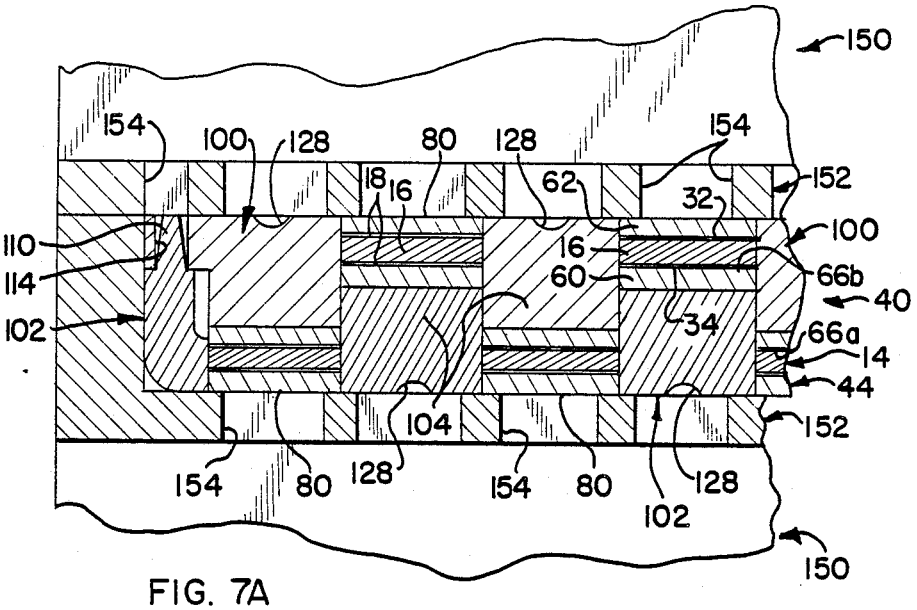
FIGS. 7A to 7C are cross-sectional views taken across the region of the wave termination showing respective shearing and two staking operations.
Figure 7B:
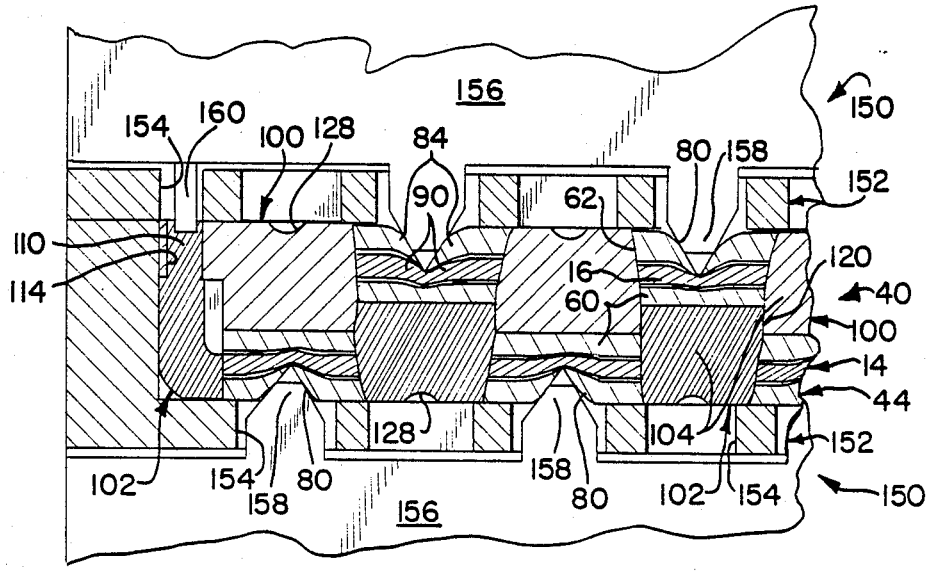
Figure 7C:
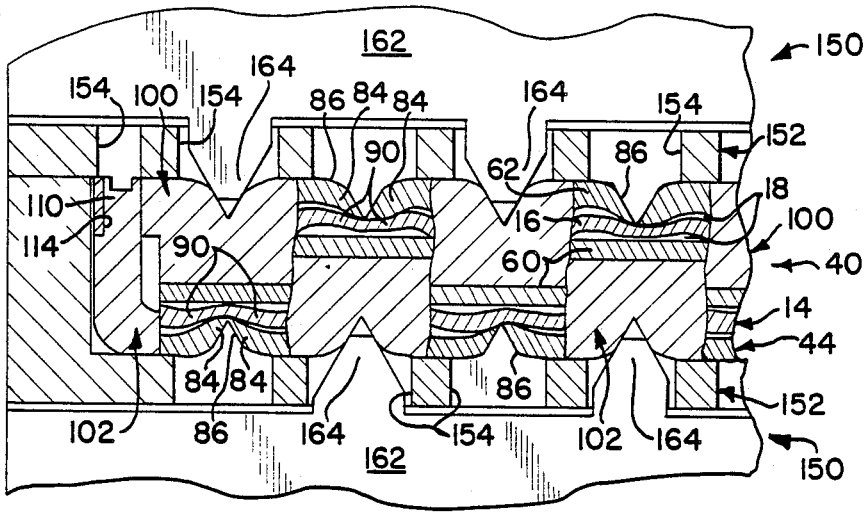
Figure 8A:
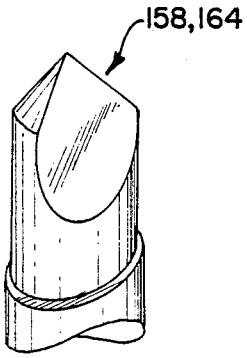
FIGS. 8A and 8B are views of the two types of staking blade tips for use in the staking operations of FIGS. 7B and 7C.
Figure 8B:
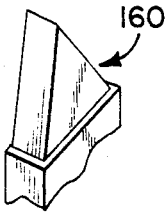
Figure 10:
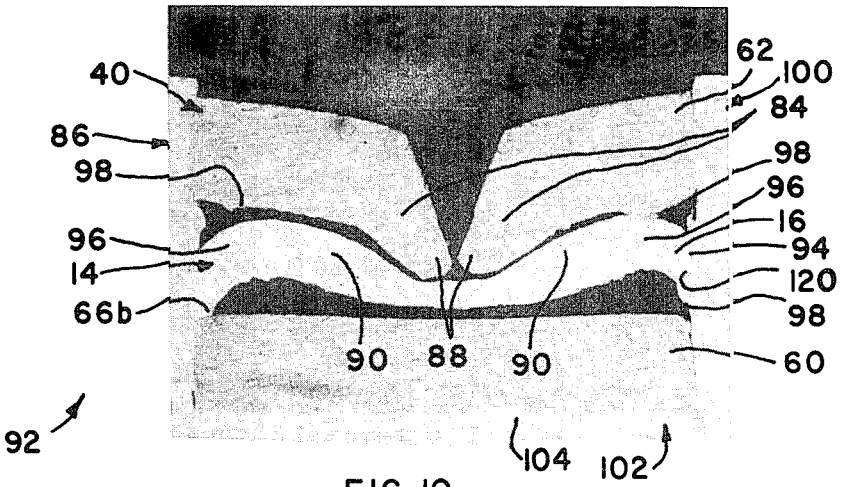

With reference to FIGS. 7A to 7C, following the application of compressive force by planar surfaces of a first pair of dies 152 of tooling 150 to shear the cable, preferably dies 152 remain locked together continually pressing most of the outer surfaces of the upper and lower portions of the transition adapter 40 against the upper and lower cable surfaces 32,34. Dies 152 may preferably have limited apertures 154 at each location of wave joint 80 and insert wave shape 104 and at both insert ends 112,116 to expose bosses 110 and the wave joints and insert wave shapes for subsequent staking operations. A second step is then performed by a second pair of dies 156 in FIG. 7B. Pointed chisel blades 158 have axially oriented tips (FIG. 8A) and simultaneously strike the transition adapter 40 from both above and below at each wave joint 80 first along the outer surfaces 82 of arcuate relief shapes 62. Referring to FIGS. 7B and 10, blades 158 penetrate into each wave joint 80 a selected depth and split the arcuate relief shapes 62 and also bend the split portions 84 down along the inside of the resultant V-shape of a staked wave joint 86 at the axial center of the wave. Split portions 84 act as paired spring members having free ends 88 which are permanently deformed by blades 158 into cable 14. With the wave crest 66 of the opposing wave 60 acting as a die, free ends 88 act on softer conductor 16 to urge portions 90 thereof laterally outwardly even though conductor portions 90 may usually remain integrally joined to each other. Spring members 84 thereafter trap conductor portions 90 against side surfaces 120 of insert member relief apertures 106 and retain them against surface 120 under spring bias, acting as stiffly compliant structures. At the same time an additional set of blades 160 (FIG. 8B) stake bosses 110 into boss-receiving apertures 114 of insert members 100,102, thereby deforming the bosses into enlarged shapes within the undercut apertures and firmly joining the inserts together at assured electrical and mechanical joints 122.

Then as is shown in FIG. 7C, as blades 158,160 are withdrawn but dies 152 remain closed, a third step is performed by a third pair of dies 162 of tooling 150. Pointed chisel blades 164 have axially oriented tips (FIG. 8A) and simultaneously strike the transition adapter 40 from above and below along the outer surfaces 124 of each insert member 100,102 at each wave shape 104 and between the now-staked wave joints 86. Blades 164 thus are pressed into the wave shapes 104 of insert members 100,102 and split and deform the softer copper material laterally and loading the contact interface between the freshly sheared edges of the cable conductor portions 90 along each staked wave joint 86 and the relief aperture side surfaces 120 of the insert members. Free ends 88 of spring members 84 also prevent the deflected conductor strips from bulging outwardly at the center during staking of the insert member wave shapes 104. Blades 158,160,164 may optionally be separate members urged into blade-receiving apertures 154 by a separate comb member (not shown).

Figure 9:
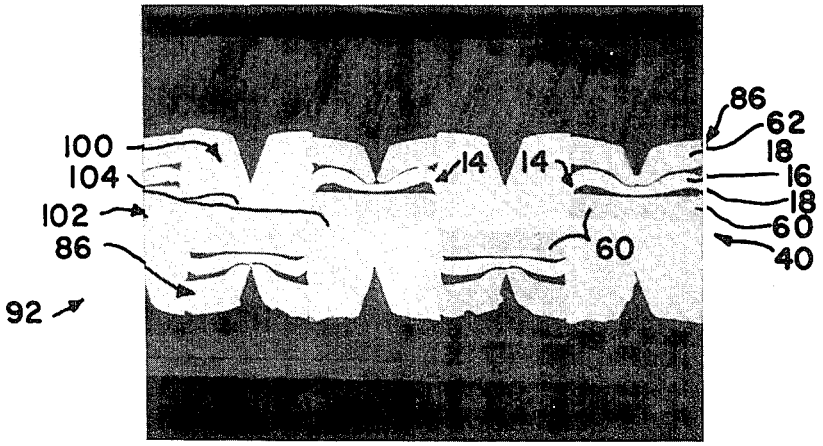
FIGS. 9 and 10 are microphotographs taken along a cross-section of a cable to which a transition adapter has been terminated as in FIGS. 7A–C, and an enlargement of a single staked wave joint thereof, respectively.

FIG. 9 is an enlarged cross-sectional view transversely through an actual termination 92 and represents the type of termination resulting from the transition adapter described with respect to FIGS. 7A to 7C. Four of the six staked wave joints 86 are seen. In FIG. 10 which is an enlargement of one of the staked wave joints 86 of FIG. 9, sheared conductor edges 94 are clearly shown tightly against adjacent side surfaces 120 of adjacent insert wave shapes forming the primary electrical connections 96 between the transition adapter and the conductor of the cable. Near the axial center of each staked wave joint 86, the conductor 16 consists of two portions 90 which have been urged laterally outwardly with sheared conductor edges 94 being impacted against surfaces 120; the curvature at 96 indicates the existence of substantial column strength creating stored energy cooperating with the adjacent staked insert portions to form an assured electrical connection. Dark layered areas 98 within staked wave joints 86 comprise portions of insulative cable covering 18 which have become lodged within available spaces and do not affect the assured mechanical and electrical connections. Measurement of resistance levels of terminations formed in this manner indicate acceptably small levels of voltage drop, indicating good electrical connections after aging at elevated temperatures. Conventional thermal shock tests indicate excellent mechanical stability in the terminations.

FIGS. 11 and 12 show an alternate embodiment of transition adapter 200 in which plate sections 202,204 are integrally joined at bight sections 206 at the forwardmost end of body member 208. Contact sections 210 comprise pin shapes and are formed of double thicknesses of the metal blank from which body member 208 is stamped, and extend rearwardly from bight sections 206 which constitute the leading ends of contact sections 210. Upper and lower plate sections 202,204 are bent upwardly at bends 212 located just rearwardly of contact sections 210 so that they diverge extending rearwardly. Cable end 214 is inserted from cable-receiving end 216 to be disposed between opposed termination regions 218,220 of upper and lower plate sections 202,204 respectively. When plate sections 202,204 are crimped onto cable end 214, wave shapes 222 will then shear cable end 214 at a region which is spaced rearwardly from the forwardmost portion of cable end 214, at a plurality of locations thereacross, and deform the thus-sheared axial strips against the inner surfaces of opposed arcuate relief shapes 224, as in the embodiment of FIGS. 2 to 7C. Four such wave shapes 222 are shown, with integral plate section straps 226 extending laterally beside the terminating regions to assist maintaining insert members 228 thereon which have been affixed to the outer surfaces of plate sections 202,204 of body member 208, although without bosses and boss-receiving apertures at ends thereof. The wave joints can then be staked and the insert member wave shapes 230 can then also be staked as in FIGS. 7A to 7C. Cable strain relief can be provided by the connector assembly into which the terminated cable end is to be secured, as disclosed in Ser. No. 07/050,793.

Figures 13A, 13B, 13C:
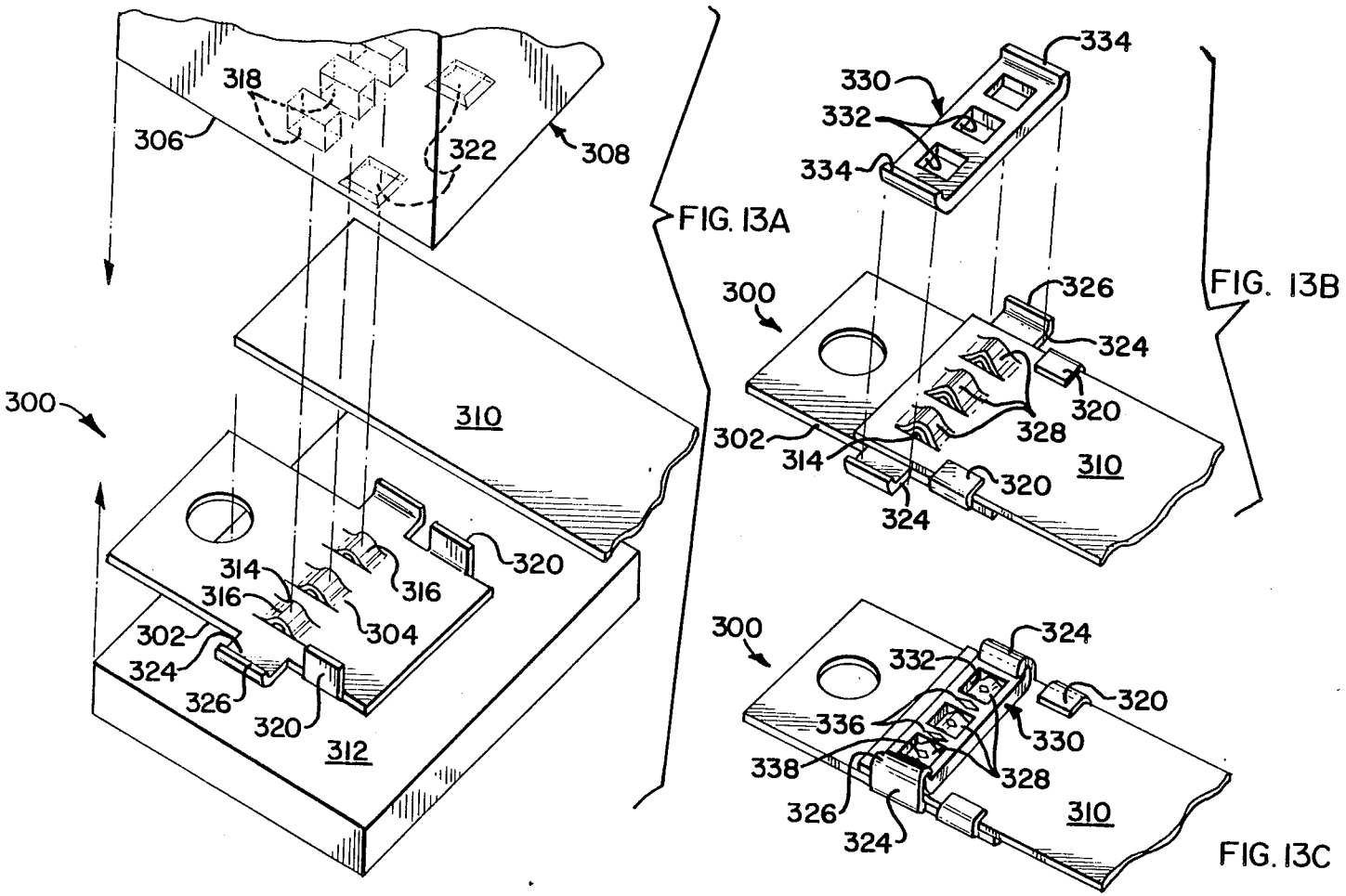
FIGS. 13A, to 13C illustrate a transition adapter having one plate section to be joined to a cable using an opposing die, and thereafter having a copper insert member secured to the terminated cable region and then staked.

In FIGS. 13A and 13B a transition adapter 300 has only one plate section 302, with one terminating region 304 thereacross although a plurality of spaced terminating regions may be desired. A die surface 306 of a die means 308 supports cable 310 while plate section 302 is applied under sufficient pressure by another die means 312 against cable 310. Crests 314 of waves 316 deflect adjacent cable portions into relief recesses 318 of die surface 306 as edges of waves 316 shear the cable conductor. Additional cable-securing means such as tabs 320 of adapter 300 may be used, which are bent around side edges of cable 310 by recesses 322 of die surface 306. Also conventional cable-piercing lances (not shown) may be used for securing as in Ser. No. 07/050,793. By shearing the cable conductor at a plurality of locations across the terminating region 304 and then deflecting the sheared conductor strips 328 out of the plane of the cable, edges of the conductor strips 328 are now exposed to be electrically connected. An insert member 330 having relief apertures 332 can then be placed across the wave region so that sheared and deflected conductor strips 328 are received in respective relief apertures 332, and the cable-proximate surface of insert member 330 is planar. Insert member 330 can then be secured to the termination by tabs 324 of adapter 300 being bent upward and over ends of the insert member so that tab flange portions 326 can be secured around upstanding insert flange portions 334, as seen in FIG. 13C. Insert member 330 can now be staked beside its relief apertures 332 as shown in FIG. 7C, leaving impressions 336; also, the conductor strips 328 can be staked similarly to the wave joint staking shown in FIG. 7B, leaving impressions 338, forming an assured electrical connection.

Figure 14A:
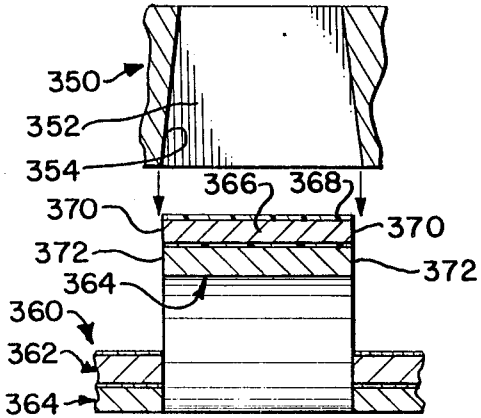
FIGS. 14A and 14B are enlarged views of a relief aperture of an alternate insert member embodiment having tapered side walls and being secured to a wave joint.
Figure 14B:
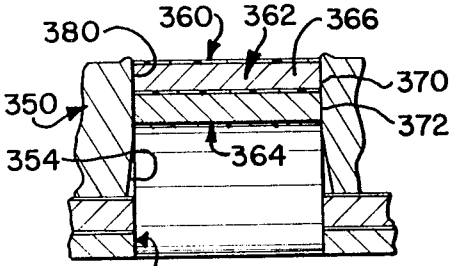

Insert member 350 in FIGS. 14A and 14B has relief apertures 352 having tapered side surfaces 354. When pressed over a wave region 360, similar to that shown in FIG. 13B, an electrical connection is formed with the cable conductor. Adapter 364 has a terminating region having a plurality of wave shapes thereacross; cable 362 has a wide, flat conductor and thin insulative covering 368 thereover; sheared and deflected conductor strip 366 has exposed conductor edges 370, and the adapter wave shape shown has shearing edges 372. As insert member 350 is pressed onto the terminating region, conductor edges 370 and wave shape edges 372 scrape and scive or deform side walls 354 near the far end of relief aperture 352 in FIG. 14B establishing an electrical connection therewith at 380. It is also possible to form vertical serrations on side surfaces of the relief apertures of the insert member, which can then scrape and scive the exposed sheared conductor edges, increasing the surface area of the electrical connection between the conductor and the insert member.

Figure 15:
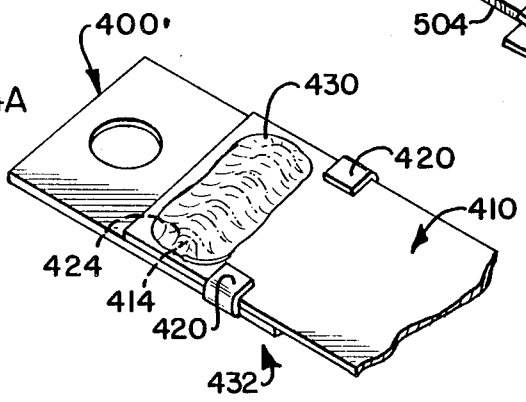
FIG. 15 illustrates using solder with a single plate adapter without an insert member.

In FIG. 15, adapter member 400 is pressed against cable 410 as shown in FIG. 13A, creating a terminating region across the cable by reason of wave shapes 414 (in phantom) shearing and deflecting conductor strips 424 (in phantom) out of the plane of the cable. Adapter member 400 can have tabs 420 to be secured to cable 410. Edges of conductor strips 424 are exposed to be electrically connected to adapter member 400 by using solder 430. Termination 432 thus formed can then be placed in an insulative housing.

Figure 16A:
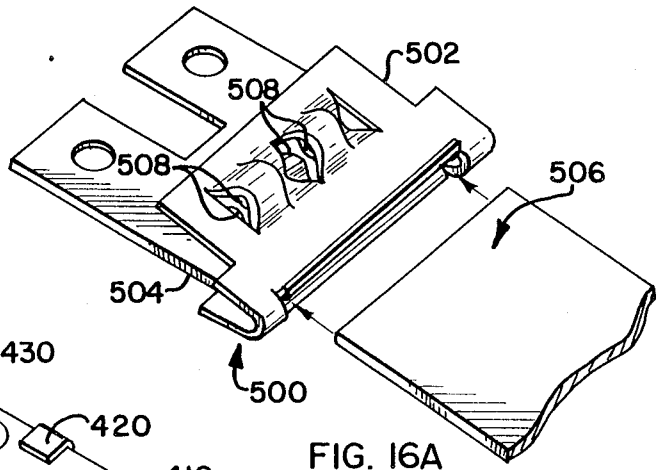
FIGS. 16A and 16B illustrate a transition adapter having a pair of plate sections as in FIG. 4 but without insert members, being mechanically joined to a cable.
Figure 16B:
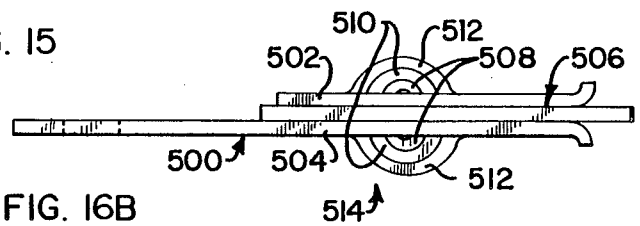

FIGS. 16A and 16B illustrate a transition adapter 400 having a pair of plate sections 502,504 and formed from a blank similar to the blank of FIG. 4. Transition adapter 500 without any insert members, can be terminated to a cable end 506 with intermeshing waves 508 deflecting and shearing cable portions as in FIGS. 6A to 6C, until the deflected cable portions are pushed against the inner surfaces of arcuate relief shapes 512. When applied to the cable the adapter has thereby been mechanically joined to the cable, with some electrical connection existing between portions of the shearing edges of the waves and portions of the sheared cable conductor. Exposed portions of sheared cable conductor edges 510 can be electrically connected such as with solder as in FIG. 15. The termination 514 can then be placed in a connector housing (not shown).

Although a transition adapter utilizing the wave crimp of the present invention preferably includes insert members of softer metal to optimize the termination for long-term in-service use, it is foreseeable that a transition adapter can be used without separate insert members and obtain significant benefits from the shearing action performed by the zero clearance opposing shearing edges of the wave shapes disclosed herein, and obtain wave joints which are mechanically strong and which provide substantial surface area of exposed cable conductor of the cable for establishing electrical connection herewith. Lateral edges of the wave shapes may be serrated if desired thus forming corresponding serrations in the sheared conductor edges and increasing the surface area thereof exposed for electrical connection such as by soldering. Also, insert members having a different configuration may be used. The plate sections can have two terminating regions instead of one, if desired, and can be separate members. Further, it is easily seen that an embodiment of the transition adapter can be terminated to a side edge of a flat cable rather than an end portion. Other modifications to the embodiments described herein may be made without departing from the spirit of the invention or the scope of the claims.

What is claimed is:

1. A transition adapter for flat power cable of the type having a flat conductor with a thin insulative covering thereover, for terminating to the conductor and electrically interconnecting the conductor to another electrical article having contact means matable with contact means of the adapter for the transmission of power, comprising:

at least a body member formed from metal having spring characteristics and suitable for transmitting power, said body member including contact means at a mating end thereof and at least a first plate section having a cable-proximate surface and including at least one terminating region, each said terminating region including a plurality of shearing edges with said first plate section being integral surrounding each said shearing edge, each said terminating region including at least one wave shape extending outwardly from said cable-proximate surface of said first plate section, each said wave shape including a crest portion extending between two parallel ones of said shearing edges, whereby each said terminating region comprises a plurality of shearing edges for shearing the insulative covering and conductor of a cable at a plurality of locations when said first plate section is pressed relatively against a portion of the cable supported by a die means having a relief recess opposed from each said wave shape, and the crest portion of each wave shape deflects a respective strip of the cable sheared by the shearing edges into a respective relief recess of the die means, whereafter upon removal from the die means substantial lengths of the sheared cable conductor are held out of the plane of the cable and exposed for electrical connection to the transition adapter, and the transition adapter is terminated to the cable.

2. A transition adapter as set forth in claim 1 wherein said shearing edges are serrated whereby the resultant sheared cable conductor edges are serrated exposing greater conductor surface area to be electrically connected.

3. A transition adapter as set forth in claim 1 further including cable-securing means providing an assured mechanical joint.

4. A transition adapter for flat power cable of the type having a flat conductor with a thin insulative covering thereover, for terminating to the conductor and electrically interconnecting the conductor to another electrical article having contact means matable with contact means of the adapter for the transmission of power, comprising:

at least a body member formed from metal having spring characteristics and suitable for transmitting power, said body member including a cable-receiving end, contact means at a mating end thereof, and opposed first and second plate sections adapted to receive a portion of a cable therebetween from said cable-receiving end, at least one of said first and second plate sections being integral with said body member, said plate sections having cable-proximate surfaces facing each other and cable-remote surfaces facing outwardly away from each other, said first plate section including at least one first terminating region and said second plate section including at least one second terminating region, said first and second terminating regions being located to be opposed from each other prior to termination to said cable, and cooperable during termination, each said terminating region including a plurality of shearing edges and each said plate section being integral surrounding a respective said terminating region thereof, said first and second terminating regions respectively comprising at least one first and second wave shape extending outwardly from said cable-proximate surface of a respective said plate section, and at least one first and second relief recess therebeside, each said at least one first and second relief recess being associated with and disposed opposed from a said second and first wave shape respectively, each said first and second wave shape including a crest portion extending between two parallel ones of said shearing edges, and said at least one first wave shape being precisely adjacent said at least one second wave shape just prior to termination so that one of said shearing edges thereof is opposed from and aligned with a respective shearing edge of the other to cooperate therewith during termination to the cable to shear said cable from opposite sides at the same location, and each said shearing edge being opposed from at least an edge formed in the opposing said plate section and cooperable therewith to shear through said cable during termination, whereby said first and second terminating regions comprise a plurality of opposed shearing edges cooperable upon said first and second plate sections being forced together against said cable portion inserted therebetween to shear the insulative covering and the conductor of the cable at a plurality of locations, and a plurality of wave shapes having respective crest portions for deflecting integral strips of said cable sheared by said shearing edges into a plurality of relief recesses, whereafter at least portions of said shearing edges engage sheared edge portions of the cable conductor and other sheared edge portions remain exposed for establishing electrical connection therewith, and the transition adapter is terminated to the cable.

5. A transition adapter as set forth in claim 4 wherein both said first and second plate sections are integral portions of said body member.

6. A transition adapter as set forth in claim 5 wherein at least one of said first and second plate sections extends toward said cable-receiving end of said body member from a bend proximate said mating end thereof and diverges from the other of said first and second plate sections, said first and second terminating regions being disposed on relatively diverging portions of said first and second plate sections respectively and said shearing edges being oriented substantially perpendicular to said bend, and said at least one of said first and second plate sections is rotated about said bend toward said other thereof during termination to said cable disposed therebetween so that said shearing edges shear said cable perpendicularly to said bend.

7. A transition adapter as set forth in claim 5 wherein said first and second plate sections are integrally joined to each other at a hinge and adapted to be pressed together by being rotated about said hinge during termination to said cable disposed therebetween, and said shearing edges of said first and second terminating regions being oriented substantially perpendicular to said hinge to shear said cable perpendicularly to said hinge during termination.

8. A transition adapter as set forth in claim 7 wherein said first and second plate sections have been rotated about said hinge toward each other to form a cable-receiving spacing therebetween prior to termination.

9. A transition adapter as set forth in claim 8 wherein said crest portions of said first and second wave shapes define a spacing thinner than the thickness of said cable prior to placing said cable portion into said cable-receiving spacing so that said cable upon insertion must deflect said first and second plate sections slightly apart, whereby a compressive spring force is established between said first and second plate sections and said cable portion inserted therebetween.

10. A transition adapter as set forth in claim 4 wherein each said wave shape includes concave portions on both sides of said crest portion thereof, and said crest portion is radiussed.

11. A transition adapter as set forth in claim 4 wherein each said first and second terminating region includes a plurality of said first and second wave shapes having ones of said first and second relief recesses therebetween, said wave shapes of each said terminating region being disposed so that respective said crest portions are aligned with each other in a selected direction, and said aligned crest portions of said first and second terminating regions are in parallel.

12. A transition adapter as set forth in claim 11 wherein said aligned, parallel crest portions are parallel to said cable-receiving end of said body member.

13. A transition adapter as set forth in claim 4 wherein said first and second relief recesses comprise openings formed between opposing parallel edges resulting from relief shapes being stamped and formed into said first and second plate sections to extend outwardly from said cable-remote surfaces thereof, said opposed parallel edges being parallel to said shearing edges of said wave shapes, and said relief shapes being integrally joined to said first and second plate sections respectively at a respective pair of spaced locations.

14. A transition adapter as set forth in claim 13 wherein at least one of said opposed parallel edges comprises a shearing edge of an adjacent said wave shape.

15. A transition adapter as set forth in claim 13 wherein said integral relief shapes are arcuate.

16. A transition adapter as set forth in claim 4 wherein each said first and second terminating region comprises a plurality of adjacent and laterally aligned said first and second wave shapes alternating with a like plurality of said first and second relief recesses respectively, disposed between a pair of integral strap sections of said first and second plate sections.

17. A transition adapter as set forth in claim 4 wherein each said first and second terminating region comprises a plurality of adjacent and laterally aligned said first and second wave shapes alternating with a like plurality of said first and second relief recesses respectively, extending completely across said first and second plate sections.

18. A transition adapter as set forth in claim 4 wherein said body member and said plate sections are plated.

19. A transition adapter as set forth in claim 4 further including first and second insert members affixed to said cable-remote surfaces of said first and second plate sections respectively at said first and second terminating regions thereof, each said insert member having a surface adjoining and shaped to conform to said cable-remote surface of the respective said terminating region and including insert wave shapes and insert relief apertures associated and aligned with the respective said wave shapes and relief recesses of the said terminating region of the adjoining said plate section, each said insert wave shape extending between parallel side surfaces aligned with edges of said terminating region of said adjoining plate section, each of said side surfaces comprising an electrical connection surface to adjoin a sheared edge of said cable conductor after termination.

20. A transition adapter as set forth in claim 19 wherein said first and second insert members are formed of relatively soft copper and are capable of being bulk deformed.

21. A transition adapter as set forth in claim 19 wherein said first and second insert members are plated.

22. A transition adapter as set forth in claim 4 wherein an insert member is associated with each said plate section and includes relief apertures associated with each said wave shape thereof, each said relief aperture having side surfaces tapering inwardly extending from a cable proximate surface to a cable-remote surface thereof, so that being pressed onto an adapter-terminated region of said cable respective ones of the sheared conductor strips deflected out of the plane of the cable are received into said relief apertures and sheared edges of the sheared and deflected conductor strips scrape said side surfaces of said insert member relief apertures for electrical connection therewith, whereafter said insert member is secured to the adapter-terminated region defining an assured termination.

23. A termination of a terminating member to a flat power cable of the type having a flat conductor and a thin insulative covering thereover, comprising:

a flat power cable defining a plane and including a flat conductor and having opposed major surfaces; and a conductive terminating member including at least a first plate section disposed against a respective said major cable surface and having at least a first terminating region having at least one wave shape extending toward said major cable surface and through said plane upon termination, each said wave shape disposed between substantially parallel shearing edges and including a crest portion extending between said shearing edges and outwardly against said major cable surface and through said plane upon termination, said shearing edges of each said wave shape remaining substantially coplanar vertically with edges of said cable conductor created by being sheared thereby when said plate section was pressed against said major cable surface in cooperation with an opposing die means having relief recesses having side edges cooperating with said shearing edges substantially under zero clearance, whereby each said wave shape has deflected an adjacent portion of the cable conductor outwardly of the cable plane during termination exposing the sheared edges of the cable conductor to be electrically connected while the deflected conductor portions remain integrally joined to the cable conductor at opposed ends.

24. A termination as set forth in claim 23 wherein an electrical connection between said exposed sheared cable conductor edges and said terminating member comprises solder.

25. A termination as set forth in claim 23 wherein an electrical connection between said exposed sheared cable conductor edges and said terminating member comprises an insert member.

26. A termination of a terminating member to a flat power cable of the type having a flat conductor and a thin insulative covering thereover, comprising opposing plate sections of a terminating member disposed against major surfaces of a conductive flat cable and having respective first and second terminating regions each having a plurality of wave shapes alternating with relief recesses, wherein each wave shape includes shearing edges along each side each of which is cooperable with at least an edge of the opposing plate section under zero clearance to shear the cable upon termination, and a crest portion extending between said shearing edges which deflects the thus-sheared cable portions into an opposing said relief recess, and after termination said shearing edges tightly engage edges of said conductor sheared thereby to form at least a mechanical connection therewith, thereby creating a plurality of interlocking wave joints.

27. A termination as set forth in claim 26 wherein first and second insert members of relatively soft copper are affixed to cable-remote surfaces of said opposing plate sections, each of said first and second insert members including a plate-proximate surface conforming to the shape of said first and second termination regions of the adjacent respective said plate section and having like insert wave shapes and insert relief apertures adjoining respective said wave shapes and relief recesses, each said insert relief aperture receiving thereinto a said wave joint upon termination and each insert wave shape being adjacent at least one of said wave joints and forming an electrical connection with major portions of the exposed sheared edges of the cable conductor within said at least one wave joint.

28. A termination as set forth in claim 27 wherein each of said insert relief apertures include side surfaces tapering inwardly extending from a plate-proximate surface to a cable-remote surface thereof so that said exposed sheared edges of the cable conductor have scraped said side surfaces for electrical connection therewith during termination.

29. A metal blank for a transition adapter for being terminated to a flat cable, comprising a member stamped from sheet metal stock and having at least a first plate section including at least a first terminating region having at least one wave shape extending outwardly from a selected surface of said member and comprising a crest portion extending transversely between parallel shearing edges, the member thereby being adapted to simultaneously shear a flat cable by said shearing edges and deflect the thus-sheared cable portion outwardly from the plane of the cable by said crest portion when the member is pressed against a major surface of the cable opposed from a die means and in cooperation with a side edge of a relief recess of the die means opposed from and associated with each wave shape of the member.

30. A metal blank as set forth in claim 29 wherein each said wave shape includes concave portions on both sides of said crest portion thereof, and said crest portion is radiussed.

31. A metal blank as set forth in claim 29 wherein said first terminating region includes a spaced plurality of said wave shapes thereacross. .

32. A metal blank for a transition adapter for being terminated to a flat cable, comprising a member stamped from sheet metal stock and having first and second plate sections joined along a transverse region selected to comprise a hinge about which said first and second plate sections are rotatable together to engage and terminate to a flat cable inserted therebetween, said first plate section including and being integral at least forwardly and rearwardly of a transverse first terminating region having a plurality of alternative first wave shapes and first relief recesses thereacross with said first wave shapes extending outwardly from a selected surface of said member in a selected direction and each comprising a crest portion extending transversely between parallel shearing edges, and said second plate section including and being integral at least forwardly and rearwardly of a transverse second terminating region having a plurality of alternating second wave shapes and second relief recesses thereacross with said second wave shapes extending outwardly from said selected surface of said member in said selected direction and each comprising a crest portion extending transversely between parallel shearing edges, said second wave shapes located to be opposed from said first relief recesses and said second relief recesses located to be opposed from said first wave shapes upon rotation of said first and second plate sections together about said hinge, with at least one said shearing edge of each of said first and second wave shapes being formed in said member at a location to be paired and precisely aligned under zero clearance with a respective opposing one said shearing edge of an adjacent offset one of said second and first wave shapes respectively, each such pair of said aligned shearing edges being cooperable to shear said flat cable upon said first and second plate sections being rotated about said hinge under sufficient force.

33. A method of terminating flat electrical cable of the type having a flat conductor member and thin insulative covering thereover, comprising the steps of:

forming a body member having a plate section having at least one terminating region, each said terminating region including a plurality of shearing edges surrounded by integral portions of said plate section, each said terminating region further including at least one wave shape, each wave shape including a crest portion extending between a pair of said shearing edges, and said body member further including contact means thereon adapted to be engaged by corresponding contact means of an electrical article;

placing a selected edge portion of said cable over said at least one terminating region of said plate section; and urging said plate section against said cable portion between die means under sufficient force until said wave shapes engage portions of said cable and said shearing edges simultaneously shear said cable at a plurality of locations along said terminating regions puncturing said thin insulative covering and forming sheared edges of said cable conductor, said wave shapes deflecting thus-sheared portions of said cable into associated opposed relief recesses of an opposed one of said die means, whereby the shearing edges of the wave shapes thereafter engage portions of said sheared conductor edges forming mechanical joints and electrical connections of said plate section with said cable conductor.

34. A method as set forth in claim 34, further including the step of soldering said sheared conductor edges and said plate section.

35. A method as set forth in claim 34 further including the step of affixing an insert member to said sheared and deflected cable portions, said insert member including relief apertures having side surfaces adapted to receive said sheared and deflected cable portions force fit thereinto to establish electrical connections between said side surfaces of said insert member relief apertures and said sheared edges of said cable conductor.

36. A method of terminating flat electrical cable of the type having a flat conductor member and thin insulative covering thereover, comprising the steps of:

forming first and second plate sections having at least one first and second terminating region respectively, each said first and second terminating region including a plurality of shearing edges surrounded by integral portions of said first and second plate sections respectively, each said first and second terminating region further including at least one first and second wave shape respectively, each wave shape including a crest portion extending between a pair of said shearing edges, and each said first and second terminating region including at least one first and second relief recess each extending between a respective pair of edges, at least one of said first and second plate sections including contact means thereon adapted to be engaged by corresponding contact means of an electrical article;

opposing and aligning said first and second plate sections such that said first wave shapes extend toward said second relief recesses and said second wave shapes extend toward said first relief recesses, said relief recesses being shaped to receive thereinto during termination said wave shapes opposed therefrom, and said shearing edges of each one of said first and second terminating regions opposing and being aligned with at least an edge of the other thereof;

placing a selected edge portion of said cable between said aligned first and second plate sections; and urging said first and second plate sections together against said cable portion therebetween under sufficient force until said wave shapes engage portions of said cable and said shearing edges simultaneously shear said cable at a plurality of locations along said first and second terminating regions puncturing said thin insulative covering and forming sheared edges of said cable conductor, said wave shapes deflecting thus-sheared portions of said cable into associated opposed relief recesses, whereby the shearing edges of the wave shapes thereafter engage portions of said sheared conductor edges forming mechanical joints and electrical connections of said first and second plate sections with said cable conductor.

37. A method as set forth in claim 36 wherein said first and second plate sections are integrally joined together at a hinge perpendicular to said shearing edges of said first and second terminating regions, and during termination said first and second plate sections are rotated together about said hinge.

38. A method as set forth in claim 37 wherein said first and second plate sections are rotated about said hinge toward each other to form a cable-receiving spacing therebetween prior to termination.

39. A method as set forth in claim 38 wherein said crest portions of said first and second wave shapes define a spacing thinner than the thickness of said cable prior to placing said cable portion into said cable-receiving spacing so that said cable upon insertion must deflect said first and second plate sections slightly apart, thus establishing a spring force between said first and second plate sections and said cable portion inserted therebetween.

40. A method as set forth in claim 36 wherein said relief recesses are formed by arcuate relief shapes extending from each respective one of said first and second plate sections outwardly in a direction opposed from said wave shapes thereof, and during termination associated ones of said wave shapes deflect said sheared cable portions into said arcuate relief shapes.

41. A method as set forth in claim 36 further including the step, after said forming step, of affixing to said first and second plate sections first and second insert members respectively to cable-remote surfaces thereof along said first and second terminating regions respectively, said first and second insert members each having an adjoining surface shaped to conform to said cable-remote surface of the respective said terminating region and including insert wave shapes and insert relief apertures associated and aligned with the respective said wave shapes and relief recesses of the said terminating region of the adjoining said plate section, each said insert wave shape extending between parallel side surfaces aligned with edges of said terminating region of said adjoining plate section, each of said side surfaces comprising an electrical connection surface to adjoin a sheared edge of said cable conductor after termination.

* * * * *

UNITED STATES PATENT AND TRADEMARK OFFICE

CERTIFICATE OF CORRECTION

PATENT NO. : 4,867,700

DATED : September 19, 1989

INVENTOR(S) : Earl R. Kreinberg

It is certified that error appears in the above-identified patent and that said Letters Patent is hereby corrected as shown below:

Col. 17, lines 27 and 30, claims 34 and 35, "34" should read --33--.

Signed and Sealed this

Eighteenth Day of June, 1991

*Attest:*

HARRY F. MANBECK, JR.

*Attesting Officer*

*Commissioner of Patents and Trademarks*